US008091720B2

(12) United States Patent
Colloud

(10) Patent No.: US 8,091,720 B2
(45) Date of Patent: Jan. 10, 2012

(54) PLASTIC BOTTLE WITH A GRIPPING PORTION

(75) Inventor: Alain Colloud, Reyvroz (FR)

(73) Assignee: SA des Eaux Minerales d'Evian SAEME, Evian-les-Bains (FR)

( * ) Notice: Subject to any disclaimer, the term of this patent is extended or adjusted under 35 U.S.C. 154(b) by 585 days.

(21) Appl. No.: 12/295,524

(22) PCT Filed: Mar. 27, 2007

(86) PCT No.: PCT/FR2007/000523
§ 371 (c)(1),
(2), (4) Date: Sep. 30, 2008

(87) PCT Pub. No.: WO2007/118966
PCT Pub. Date: Oct. 25, 2007

(65) Prior Publication Data

US 2010/0230378 A1 Sep. 16, 2010

(30) Foreign Application Priority Data

Apr. 4, 2006 (FR) ..... 06 02942

(51) Int. Cl.
*B65D 23/10* (2006.01)

(52) U.S. Cl. ..... 215/384; 215/398; 220/675

(58) Field of Classification Search ..... 215/382, 215/384, 398, 383; 220/672, 771, 772, 675
See application file for complete search history.

(56) References Cited

U.S. PATENT DOCUMENTS

| | | | | | |
|---|---|---|---|---|---|
| 3,536,500 | A | * | 10/1970 | Cleereman et al. | 426/130 |
| 3,537,498 | A | * | 11/1970 | St Amand | 604/403 |
| 5,224,614 | A | * | 7/1993 | Bono et al. | 215/384 |
| 5,385,250 | A | | 1/1995 | Pasquale | |
| 5,713,480 | A | * | 2/1998 | Petre et al. | 215/373 |
| D395,821 | S | * | 7/1998 | Tabaroni et al. | D9/696 |
| D402,896 | S | * | 12/1998 | Conrad | D9/543 |
| 5,988,417 | A | * | 11/1999 | Cheng et al. | 215/383 |
| 6,494,333 | B2 | * | 12/2002 | Sasaki et al. | 215/384 |
| 6,575,321 | B2 | * | 6/2003 | Bourque et al. | 215/384 |

(Continued)

FOREIGN PATENT DOCUMENTS

EP 1 348 636 1/2003

(Continued)

OTHER PUBLICATIONS

International Search Report dated Aug. 27, 2007, in PCT application.

*Primary Examiner* — Sue Weaver
(74) *Attorney, Agent, or Firm* — Young & Thompson

(57) ABSTRACT

Plastic bottle including a body (9) extending along a central axis (Z) that includes a lower portion (3) with a substantially constant cross section; followed by a gripping portion (4); and terminated by an upper portion (5) with a substantially constant section and arranged to correspond with the cross section of the lower portion. The gripping portion (4) includes two globally plane gripping panels (41) arranged to be parallel to each other and to the central axis (Z) at a distance convenient for gripping with the hands. These panels have at least one reinforcing relief (44; 45) extending in a transverse plane, and are connected to each other by connecting panels (42) extending along the lower portion (3) and the upper portion (5), through rounded angles located at the circumferential ends of the panels.

13 Claims, 2 Drawing Sheets

U.S. PATENT DOCUMENTS

| | | | | |
|---|---|---|---|---|
| 6,739,467 | B2 * | 5/2004 | Saito et al. | 215/384 |
| 6,837,390 | B2 * | 1/2005 | Lane et al. | 215/381 |
| 2002/0020687 | A1 | 2/2002 | Sasaki | |
| 2003/0205550 | A1 * | 11/2003 | Prevot et al. | 215/384 |
| 2009/0159557 | A1 * | 6/2009 | De Vel et al. | 215/384 |

FOREIGN PATENT DOCUMENTS

| | | |
|---|---|---|
| FR | 1 397 037 | 4/1965 |
| FR | 1 416 663 | 2/2002 |
| GB | 2 330 125 | 4/1999 |
| WO | WO 99/21770 | 5/1999 |

* cited by examiner

PLASTIC BOTTLE WITH A GRIPPING PORTION

FIELD OF THE INVENTION

The present invention relates to a bottle made of plastic material having a gripping zone intended in particular but not exclusively for containing a large quantity of drink.

More specifically, the invention relates to a bottle having a bottom from which a body extends longitudinally along a central axis to a neck which ends in a ring forming a pouring opening and is adapted to receive a closing element, said body comprising from the bottom to the neck:

- a lower portion having a cross section with an essentially constant profile, followed by
- a gripping portion, and ending in
- an upper portion having a section with an essentially constant profile arranged in alignment with the profile of the section of the lower portion.

BACKGROUND OF THE INVENTION

Bottles of this type have to satisfy various constraints associated with their transport and the pouring convenience for the user while having to be as light as possible in order to reduce costs associated with the quantity of plastic material used and to reduce the impact on the environment.

Gripping bottles for pouring their contents poses problems for some users when the capacity reaches 1.5 l, and for the majority of them as of a capacity of 2 l, on account of the transverse dimensions of the body of the bottle, given that the height of the bottle cannot be increased excessively for fear of causing awkward tipping as a result of displacement of the liquid during pouring.

The diameter of the bottles has therefore been reduced in the gripping zone by forming a deep annular groove at the gripping zone as described, for example, in document U.S. Pat. No. 5,385,250. However, such a solution poses problems of resistance to the vertical load to which the bottle is subjected during transport.

Ergonomic hollows have also been formed in the wall of the gripping zone, and document EP-A-0 837 006 may be cited by way of example. Nevertheless, in order to obtain a handle shape which is sufficiently small for the hand of the majority of users, the hollows have to be deep, which results in a large amount of plastic material being used and may pose problems of resistance to large increases in internal pressure which arise during transport.

Moreover, a certain rigidity of the gripping portion is necessary for gripping comfort and in order to avoid liquid being projected as may happen when the user grips an open almost full bottle firmly.

During transport, under the effect of the load of stacked bottles and other factors, the bottles inevitably undergo increases in internal pressure. If a portion of the wall of the body is deformed excessively, the volume of the bottle increases, the internal pressure decreases and the bottle is crushed vertically, which may result in a stack of pallets of bottles tipping. The structural strength could of course be increased by increasing the thickness of the wall, but this runs counter to the requirement of economy of plastic material.

The vertical load supported by the bottle is transmitted from the closing element to the bottom by means of the neck and the body of the bottle where the plastic material is of minimum thickness. The resistance to vertical compression must be accompanied by a certain vertical elasticity which allows the internal pressure of the full bottle to be increased and consequently better resistance to compression provided that the wall of the body, including the gripping portion, is not appreciably radially deformed.

SUMMARY OF THE INVENTION

It is therefore an object of the present invention to meet these requirements while providing a gripping portion which is comfortable for the majority of users.

To this end, the present invention relates to a bottle of the type mentioned above wherein the gripping portion comprises at least two globally plane gripping panels arranged parallel to one another and in relation to the central axis of the bottle at a distance from one another which is adapted for taking in hand, said panels having at least one reinforcing relief which extends globally in a transverse plane of the body and being interconnected by connecting panels extending in continuation of the lower and upper portions of the body by means of rounded corners located at the circumferential ends of said panels.

By virtue of these arrangements, a gripping portion of particularly simple shape, which is therefore sparing in terms of plastic material, is obtained, with gripping panels which are flat but resistant to pressure by virtue of the reinforcing relief. Moreover, the vertical stresses are of course transmitted by the connecting portions but above all by the corners connecting the connecting panels which, because of their radius of curvature which is much smaller than that of the panels of the gripping zone, behave structurally like beams. Applying these arrangements has made it possible to produce 1.5 l and 2 l bottles which satisfy the tests of transport strength and user convenience while having a lower weight than bottles of the same capacity which are currently sold and are less easy to take in the hand.

In preferred embodiments of the invention, use is furthermore made of one or other of the following arrangements:

- said at least one relief of the gripping panels extends through the corners;
- said at least one relief of the gripping panels is formed by a flute;
- the flute has a depth at the corners which is substantially smaller than the depth in the central zone of the gripping panels, that makes it possible to favor the transmission of vertical stresses in the zone of the corners whereas, in the central zone of the gripping panels, the resistance to radial deformation is favored;
- the gripping panels have a plurality of flutes, the flute passing through the central zone having a larger section than the flute located close to a longitudinal end of said gripping panel;
- the gripping panels have a plurality of flutes which are shaped and arranged so as to form a zone free from relief in the central zone of said gripping panels;
- the gripping panels have in their central zone a slight recessed depression, which makes it possible to distribute the pressure exerted by a thumb, for example, and thus to avoid folding of the flute by localized concentration of force;
- the gripping panels have an elongate rectangular shape which is oriented in a transverse plane of the body;
- the maximum height of the gripping panels in their central zone is between 2 and 4 cm, and the gripping zone is located at between half and two thirds of the height of the bottle measured from the bottom;
- the gripping panels are connected longitudinally to the lower and upper portions of the body by surfaces which are inclined in relation to the central axis and form between them an opening angle of between 100 and 150°;

the profile of the cross section of the lower and upper portions of the body has a given major dimension, and the distance separating the gripping panels is between 75 and 90% of said given distance, and is preferably approximately equal to 82% of this distance;

the profile of the sections of the lower and upper portions is on the whole rectangular, and the gripping panels extend parallel to the long sides of this rectangular profile.

BRIEF DESCRIPTION OF THE DRAWINGS

Other features and advantages will emerge from the description below which is given by way of non-limiting example with reference to the accompanying drawings.

In the various figures, the same references have been used to designate identical or similar elements.

DETAILED DESCRIPTION

Figure 1:
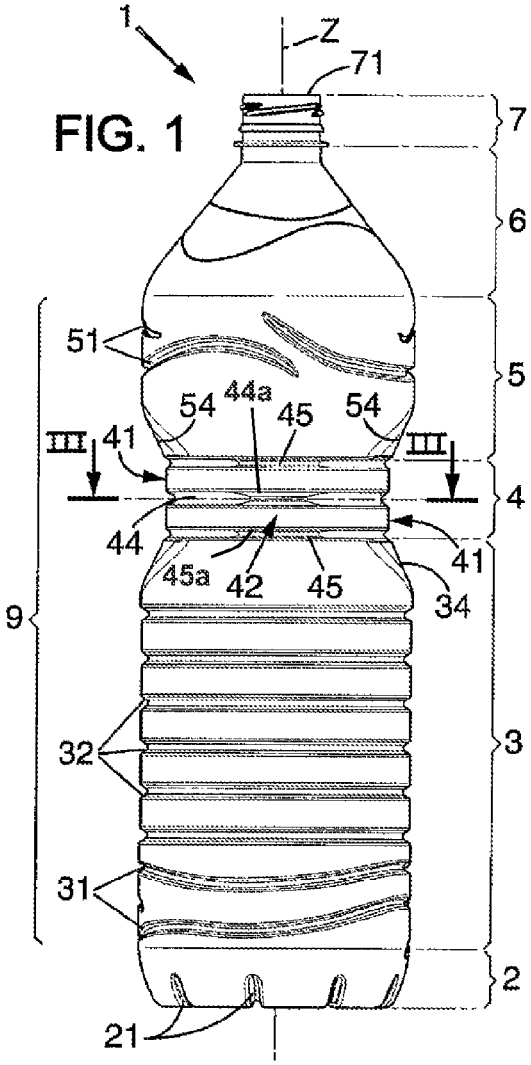
FIG. 1 is a front view of a first embodiment of a bottle according to the invention.
Figure 2:
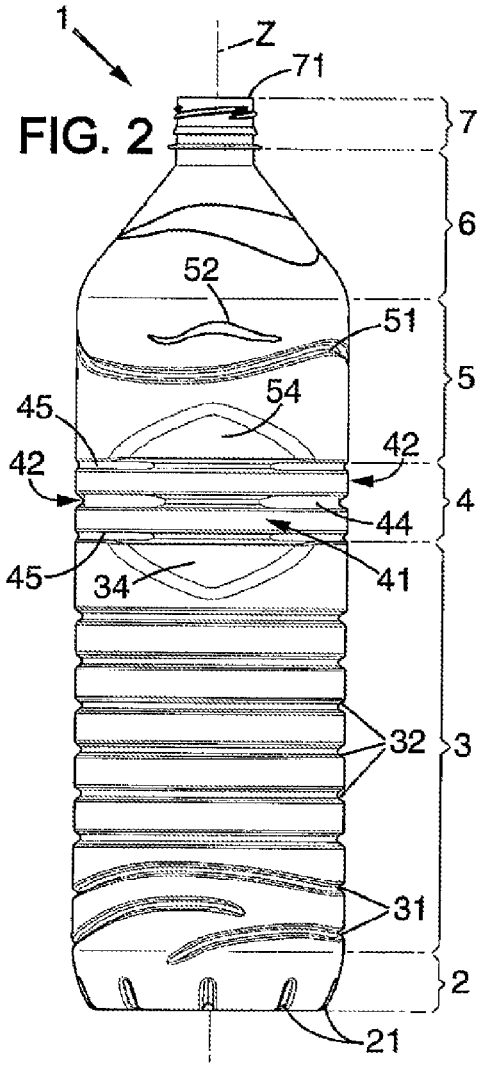
FIG. 2 is a side view of FIG. 1.

FIGS. 1 and 2 show from the front and the side a bottle 1 made of plastic material intended to contain roughly 2 liters of still water.

The bottle 1 extends longitudinally along a vertical central axis Z. It has, from its base to its top, a bottom 2, a lower portion 3, a gripping portion 4, an upper portion 5, a neck 6 and a ring 7 defining a pouring opening 71. The lower, gripping and upper portions 3, 4 and 5 constitute a body 9 of the bottle.

For comfortable pouring of the liquid with a bottle of this capacity, it is preferable if the gripping portion 4 is located above half-height of the bottle but below three quarters of its total height.

The bottle 1 is formed from a single piece of plastic material, PET in the embodiment shown, which is shaped by heat blow-molding a preform in a mold. Heat blow-molding makes it possible to stretch the plastic material biaxially and to provide it with rigidity. Heat blow-molding also makes it possible to reduce the thickness of the wall of the body 9 considerably in relation to the thickness of the wall of the preform. This small thickness of the walls of the body of the bottle, which may be of the order of 150 to 300 micrometers depending on the zone considered, is important for achieving a saving in material and therefore in weight.

The bottom 2 rises over a relatively great height from the support plane of the bottle. It comprises ribs 21 and its average thickness is a little greater in order to reinforce this part which has to transmit the weight of the bottle and of any bottles stacked above it on a surface which may be more or less plane and regular. Other more or less complex shapes for the bottom 2 are of course possible, in particular if the bottle is for a carbonated drink and has to withstand great internal pressures, even when it is not resting on its bottom.

Figure 3:
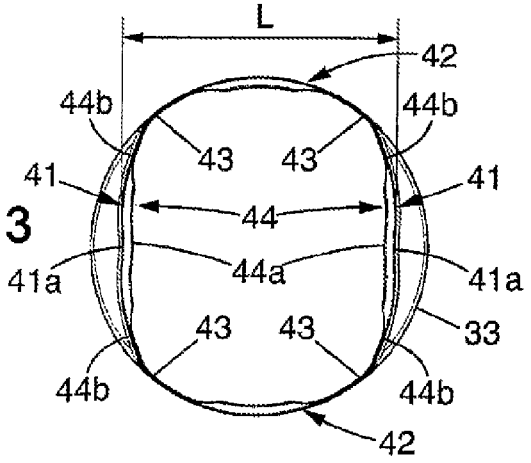
FIG. 3 is a view in section along the line III-III in FIG. 2.

The lower portion 3 of the body 9 has reinforcing reliefs (31, 32), here recessed in relation to the external profile 33, which can be seen in FIG. 3, of the cross section of this portion. These reinforcing reliefs can take various forms, such as for example undulating grooves 31 or annular flutes 32 arranged horizontally, that is to say located in transverse planes in relation to the central axis Z of the bottle. The reliefs (31, 32) must make it possible to support the internal pressure of the bottle but also provide longitudinal elasticity in order to allow an increase in the internal pressure of the liquid and therefore resistance to vertical crushing.

The profile 33 of the cross section of this lower portion 3 is circular and constant over the length of this portion in the embodiment shown, this portion being considered outside the reliefs (31, 32). The walls of the lower portion 3 are thus vertical and adapted for supporting a load in this direction. It is conceivable to make a slight variation in the profile of the section along the lower portion 3, for example by using a slightly frustoconical shape, but major and/or geometrically important variations are to be avoided in order to retain good crushing resistance.

In a similar way to the lower portion 3, the upper portion 5 comprises more or less pronounced reliefs 51, 52, either for increasing resistance to deformation as in the case of the undulating grooves 51 or for purely aesthetic reasons as in the case of the light reliefs 52.

The profile of the upper portion 5 is likewise circular and constant in the embodiment shown. The profile of the section of this portion is coaxial with the profile 33 of the lower portion 3, given that these lower and upper portions (3, 5) extend longitudinally along the same central axis Z. The circular profile has the same diameter as that of the lower portion 3. The profiles of the lower and upper portions (3, 5) are therefore in alignment and are well-adapted for transmitting vertical stresses from the neck 6 toward the bottom 2. In the same way as for the lower portion 3, however, the upper portion 5 can have a certain variation in section while retaining a capacity for transmitting vertical stresses and taking account of the overall shape of these two portions in relation to one another.

The profile of the section of the lower and upper portions (3, 5) can be other than circular, for example polygonal with rounded corners, while providing sufficient resistance to the internal pressures exerted radially and to the stresses exerted vertically on these portions.

The neck 6 has a frustoconical shape connected by a rounded bend to the upper portion 5. However, other well-known shapes for the neck can be used. The top of the neck 6 is connected to the ring 7 by quite a pronounced angle, but the greater thickness of the wall in this region affords great resistance to deformation.

The ring 7 is a well-known triple-thread ring. The ring 7 is intended to receive a screwable top (not shown in the figures). However, any type of stoppering element may of course be used.

The gripping portion 4 comprises two gripping panels 41, one of which can be seen from the front in FIG. 2, and two connecting panels 42, one of which can be seen from the front in FIG. 1. Each gripping panel 41 is connected directly at each of its circumferential ends by a corner 43 to the circumferential ends of each of the connecting panels 42, as can best be seen in FIG. 3.

The gripping panels 41 are on the whole plane, when considering their transverse dimension, but can, as in the embodiment shown, comprise slight curvatures which will be explained in detail below. The gripping panels 41 are arranged parallel to one another at a distance L from one another which is adapted for taking in the hand. By way of illustration, the bottle shown in FIGS. 1 to 3 has lower and upper portions (3, 5) of roughly 100 mm in diameter, which does not allow easy taking in the hand for the majority of adults, whereas the distance L separating the two gripping panels 41 is roughly 81 mm, which distinctly facilitates taking the bottle in the hand for the majority of users.

The connecting panels 42 extend in continuation of the lower and upper portions (3, 5) of the body 9. Considered over the circumferential portion comprising the connecting panels 42, the body of the bottle thus has a continuous surface which is advantageous for transmitting the vertical loads between the neck 6 and the bottom 2.

The corners 43 are located in the circumferential connection zone of the gripping panels 41 with the connecting panels 42. The corners 43 are formed by a portion extending vertically from the lower portion 3 to the upper portion 5 and circumferentially over an angular sector originating from central axis Z limited to a few degrees. The transverse profile of the corners 43 is a circular arc with a radius which is considerably smaller than that of the body, so that it has a rounded shape. The corners 43 play an important role in the transmission of the vertical stresses because of this rounded profile which constitutes structurally a vertical girder and make it possible to compensate for the reduction in vertical strength due to the gripping panels 41. The corners 43 also have an effect on the quality of taking hold of the bottle. Corners with too marked an angular shape which gives rise to a ridge are to be avoided in order to prevent a concentration of stresses which are detrimental to the load resistance, in particular when impacts take place.

As can be seen in FIG. 1, the gripping panel 41 comprises reinforcing reliefs (44, 45) which extend along the gripping zone in a transverse plane, that is to say along the greatest length of the panel. In fact, it is necessary to avoid the gripping panels 41 adopting an arched shape around the central axis, either toward the outside when the pressure inside the bottle increases, or toward the inside when the user exerts pressure on these panels. More specifically, the reinforcing reliefs comprise a central relief 44 which is in the form of an annular flute and consequently likewise extends on the connecting panels 42. Two lateral reliefs 45 of similar shape are arranged close to the upper and lower longitudinal ends of the gripping panel 41.

A good compromise between improving the gripping comfort and retaining the structural strength of the bottle can be achieved with a distance L separating the gripping panels 41 which is between 75 and 90% of the greatest dimension of the cross section of the lower or upper portions (3, 5), here, that is, the diameter of these sections. For a 1.5 l to 2 l bottle intended to contain a non-carbonated drink, a distance L roughly equal to 80% of the major dimension proves to be particularly appropriate. However, this ratio can vary markedly depending on the volume of the bottle or the shape of the section and, for example, in the case of bottles which have a much smaller capacity but the gripping portion of which has to be adapted to the shape of the hand of a child.

It will be observed that the flutes (44, 45) of the gripping panels 41 extend to the connecting panels 42 and pass through the corners 43 connecting these panels. It has been established that this reinforced the resistance to bulging of the gripping panels 41 and can be explained by the fact that these reinforcements 44, 45 form undulations at the corners 43 and limit the flexion possibilities of the gripping panels around these corners.

Moreover, the annular flutes (44, 45) of this portion 4 have a depth which varies according to the circumferential zone considered in order to optimize according to zones the resistance to bulging of the gripping panels 41 or of the connecting panels 42 and the resistance to vertical stresses of the gripping portion 4. More specifically, in the central part of the gripping panels, the flutes (44, 45) have a zone (44*a*, 45*a*) of a depth which is greater than in the zone (44*b*, 45*b*) located at the corners 43.

The central reinforcing flute 44 has a slightly greater depth and height than the lateral flutes 45 in order to limit the flexion of the central zone of the gripping panels 41 which is likely to be subjected to a greater localized force exerted radially toward the inside when the user grips this zone with his thumb.

To limit localized shaping by the thumb of the user, provision is likewise made for the profile of the gripping panels 41 to depart from a straight line and adopt the shape of a double undulation, as can be seen in FIG. 3, with a slight depression 41*a* in the central zone. By virtue of this, this zone follows the rounded shape of the thumb more closely and the force exerted by it is distributed over a larger surface, which significantly reduces the risk of sudden deformation of the central flute 44 (flute breaking).

The gripping panels 41 have a length, measured in a transverse plane, which is greater than their height. The gripping panels therefore have a transversely oriented elongate rectangular shape. In this first embodiment, the gripping portion extends over a height of roughly 3 cm, which proves to be sufficient for good taking in the hand and for locating a number of reinforcing flutes, possibly with sections of different shape. For these reasons, however, it is preferable if the gripping panels 41 have at least in a central zone a height greater than 2 cm. However, the gripping panels are not to have a maximum height greater than 5 cm because, with such a large dimension, it is more difficult to meet the requirements of rigidity of these panels and reduced weight of the bottle.

The gripping panels 41 are connected at their lower longitudinal end to the lower portion 3 by inclined surfaces 34, here of an on the whole triangular shape owing to the circular section of the body 9. In the same way, the upper longitudinal end of the gripping panels 41 is connected to the upper portion 5 by similar inclined surfaces 54. It appears preferable for these inclined surfaces to form between them an opening angle $\alpha$, indicated in FIG. 4, of between 100 and 150° in order to increase the height of the zone over which the user can place his fingers while keeping an angle which is sufficiently pronounced that each upper inclined surface 54 forms a point for retaining the hand.

By virtue of the gripping panels 41 thus arranged, a gripping portion 4 is obtained of which the cross section has an essentially rectangular profile, here with circular-arc-shaped short sides owing to the cylindrical shape of the body 9. This gripping portion proves comfortable for the user and can be used in two opposed directions. Furthermore, the structural strength of the bottle can be retained without any additional use of plastic material in relation to an optimum cylindrical shape.

Moreover, in the case of a bottle body having a rectangular or square section with rounded corners, the gripping panels preferably extend parallel to opposite sides of this section, and parallel to the long sides of this section if the profile thereof is a non-square rectangle.

It is conceivable to form more than a pair of gripping panels as long as these are separated circumferentially by connecting panels. In this case, however, the quantity of plastic material necessary would be greater in order to retain similar strength.

Figure 4:
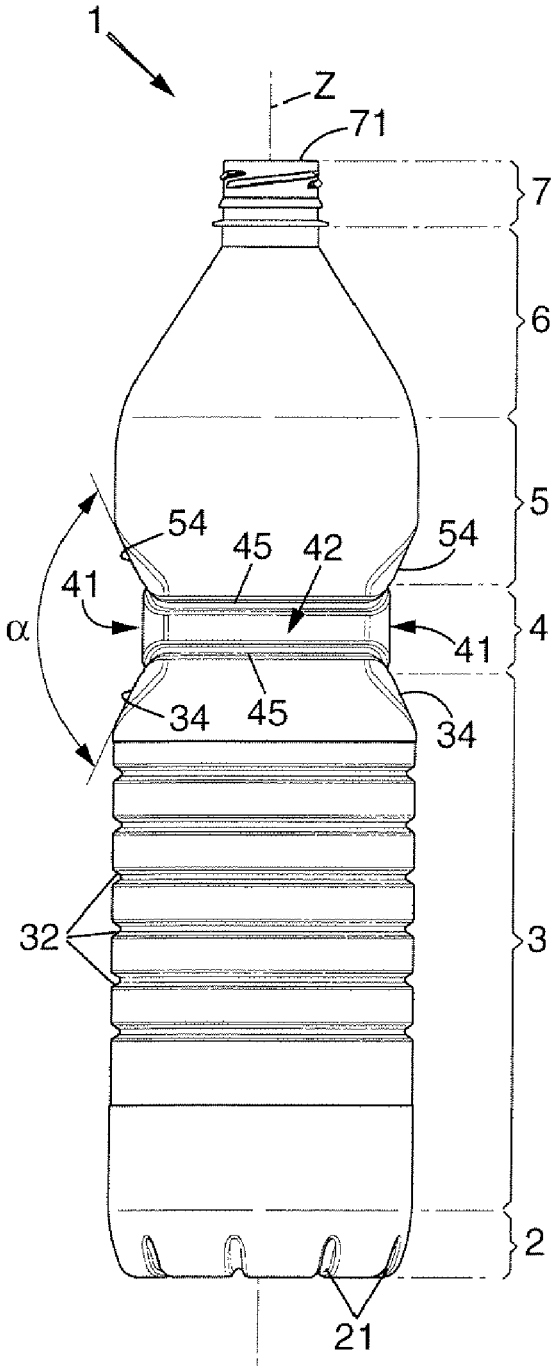
FIG. 4 is a front view of a second embodiment of a bottle according to the invention.
Figure 5:
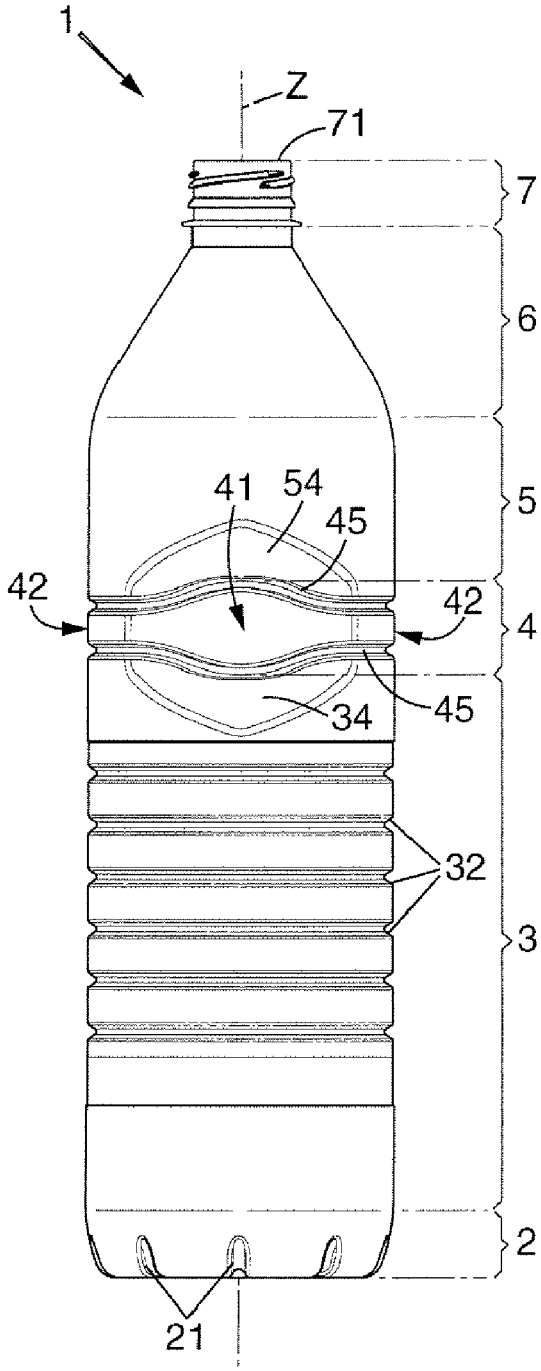
FIG. 5 is a side view of FIG. 4.

A second embodiment of the gripping panels applied here to a 1.5 l capacity bottle 1 is shown in FIGS. 4 and 5. The majority of the component elements of this bottle are similar in all respects to those of the embodiment shown in FIGS. 1 to 3 and will not be described in detail again. The profile of the cross section of the upper and lower portions (3, 5), not shown for this embodiment, is likewise circular but of a smaller diameter of roughly 88 mm, which makes it possible to space the gripping panels at a slightly smaller distance L, namely roughly 72 mm, which likewise represents around 82% of the major dimension.

Here, the gripping panels 41 comprise only two reinforcing flutes 45 arranged at the longitudinal ends of these panels. These upper and lower flutes each constitute an undulation, directed upward and downward respectively, in the central zone of the gripping panels 41. The maximum height of these panels is therefore, as in the preceding embodiment, of the order of 2 cm in order to provide a good grip but smaller toward the circumferential ends. This makes it possible to optimize the volume and weight of the bottle.

For this reason, the central zone of the gripping panels 41, on which the thumb of the user is likely to exert great pressure, is without reinforcing reliefs. The increase in flexibility of the wall in this zone therefore has the advantage of better distributing the stresses exerted by the user.

In the same way as in the first embodiment for which it is possible to achieve a weight of the order of 40 grams, the 1.5 l bottle in this second embodiment makes it possible to obtain a light bottle of the order of 32 grams with comfortable gripping and satisfactory resistance to deformation.

These embodiments are of course in no way limiting. As indicated above, the bottles could be bottles having a body of on the whole polygonal section with rounded tops, and, although the invention is particularly useful for large capacity bottles, it can also be applied to bottles of small capacity, of 33 or 50 cl for example, intended for children.

The invention claimed is:

1. A bottle made of plastic material having a bottom from which a body extends along a central axis to a neck which ends in a ring forming a pouring opening and is adapted to receive a closing element, said body comprising from the bottom to the neck:

a lower portion having a cross section with an essentially constant profile, followed by a gripping portion, and ending in an upper portion having a section with an essentially constant profile arranged in alignment with the profile of the section of the lower portion, wherein the gripping portion comprises at least two globally planar gripping panels arranged parallel to one another and in relation to the central axis at a distance from one another which is adapted for taking in hand, wherein said gripping panels have at least one reinforcing relief which extends globally in a plane of the body, and wherein said gripping panels are interconnected by connecting panels by means of rounded corners located at the circumferential ends of said panels, said connecting panels extending in continuation of the lower and upper portions of the body.

2. The bottle as claimed in claim 1, wherein said at least one relief of the gripping panels extends through the corners.

3. The bottle as claimed in claim 1, wherein said at least one relief of the gripping panels is formed by a flute.

4. The bottle as claimed in claim 3, wherein the gripping panels have each a central zone and the flute has a depth at the corners which is substantially smaller than the depth in the central zone of the gripping panels.

5. The bottle as claimed in claim 3, wherein the gripping panels have each a central zone, the gripping panels having a plurality of flutes, the flute passing through the central zone having a larger section than the flute located close to a longitudinal end of said gripping panel.

6. The bottle as claimed in claim 3, wherein the gripping panels have each a central zone, the gripping panels having a plurality of flutes which are shaped and arranged so as to form a zone free from relief in the central zone of said gripping panels.

7. The bottle as claimed in claim 1, wherein the gripping panels have each a central zone, the gripping panels having in their central zone a slight recessed depression.

8. The bottle as claimed in claim 1, wherein the gripping panels have each a central zone and the maximum height of the gripping panels in their central zone is between 2 and 4 cm, and wherein said gripping portion is located at between half and three quarters of the height of the bottle measured from the bottom.

9. The bottle as claimed in claim 1, wherein the gripping panels are connected longitudinally to the lower and upper portions of the body by surfaces which are inclined in relation to the central axis and form between them an opening angle of between 100 and 150°.

10. The bottle as claimed in claim 1, wherein the profile of the cross section of the lower and upper portions of the body has a given major dimension, and the distance separating the gripping panels is between 75 and 90% of said given major dimension.

11. The bottle as claimed in claim 10, wherein the distance separating the gripping panels is approximately equal to 82% of said given major dimension.

12. The bottle as claimed in claim 1, wherein the corners are each contiguous to one of said gripping panels and to one of said connecting panels.

13. A bottle made of plastic material having a bottom from which a body extends along a central axis to a neck which ends in a ring forming a pouring opening, said body comprising from the bottom to the neck:

a lower portion having a cross section with an essentially constant profile, followed by a gripping portion, and ending in an upper portion having a section with an essentially constant profile arranged in alignment with the profile of the section of the lower portion, wherein the gripping portion has two globally planar gripping panels arranged parallel to one another, wherein said two gripping panels have at least one reinforcing relief which extends globally in a transverse plane of the body, and wherein said two gripping panels are interconnected by two connecting panels by means of four respective rounded corners located at the circumferential ends of said panels, said connecting panels extending in continuation of the lower and upper portions of the body.

* * * * *